US008128245B2

(12) United States Patent
Limjoco

(10) Patent No.: US 8,128,245 B2
(45) **Date of Patent: *Mar. 6, 2012**

(54) MAKE-UP MIRROR WITH AIRFLOW COMPONENT

(76) Inventor: Lisa Limjoco, Elm Grove, WI (US)

( * ) Notice: Subject to any disclaimer, the term of this patent is extended or adjusted under 35 U.S.C. 154(b) by 295 days.

This patent is subject to a terminal disclaimer.

(21) Appl. No.: 12/240,748

(22) Filed: Sep. 29, 2008

(65) Prior Publication Data

US 2010/0073792 A1 Mar. 25, 2010

Related U.S. Application Data

(60) Provisional application No. 61/100,183, filed on Sep. 25, 2008.

(51) Int. Cl.
*G02B 7/18* (2006.01)

(52) U.S. Cl. ..... 359/872; 416/5; 248/486; 454/228; D23/387; D23/411

(58) Field of Classification Search ..... 359/838–884; D23/355, 370, 387, 411; 454/228–236; 416/5, 416/69–72, 70 A See application file for complete search history.

(56) References Cited

U.S. PATENT DOCUMENTS

| | | | | |
|---|---|---|---|---|
| 3,711,182 | A * | 1/1973 | Jasgur | 359/488.01 |
| 4,037,079 | A | 7/1977 | Armbruster | |
| 4,701,594 | A | 10/1987 | Powell | |
| 4,988,847 | A | 1/1991 | Argos et al. | |
| 5,090,300 | A | 2/1992 | Berenstein | |
| 5,251,066 | A | 10/1993 | Appelbaum | |
| D415,271 | S * | 10/1999 | Feer | D23/411 |
| D421,114 | S * | 2/2000 | Lozzio et al. | D23/382 |
| D438,293 | S | 2/2001 | Munoz, Jr. | |
| 6,206,530 | B1 * | 3/2001 | Eberts | 359/879 |
| D441,068 | S * | 4/2001 | Bogazzi | D23/411 |
| D445,494 | S * | 7/2001 | Leslie | D23/411 |
| 6,349,484 | B1 | 2/2002 | Cohen | |
| D460,542 | S * | 7/2002 | Li | D23/328 |
| D466,606 | S * | 12/2002 | Shapiro | D23/411 |
| 6,682,308 | B1 * | 1/2004 | Fei et al. | 416/246 |
| D510,994 | S * | 10/2005 | Indio Da Costa | D23/382 |
| D531,296 | S * | 10/2006 | Chen | D23/370 |
| D541,926 | S * | 5/2007 | Russak et al. | D23/382 |
| D614,280 | S * | 4/2010 | Dyson et al. | D23/370 |
| 2005/0068646 | A1 * | 3/2005 | Lev et al. | 359/871 |
| 2005/0231835 | A1 * | 10/2005 | Tokushita et al. | 359/871 |
| 2010/0118520 | A1 * | 5/2010 | Stern et al. | 362/135 |

FOREIGN PATENT DOCUMENTS

| | | |
|---|---|---|
| JP | 2004/201709 | 7/2004 |

* cited by examiner

*Primary Examiner* — Jennifer L. Doak
(74) *Attorney, Agent, or Firm* — Absolute Technology Law Group, LLC

(57) ABSTRACT

The invention disclosed herein is a make-mirror designed to direct airflow to a user's face, and includes a mirror embedded in a housing that encases a fan, and is vented to direct airflow to a user's face. Various embodiments may include lighting, bases, stands, extension arms, components for flush mounting the invention to a wall, electrical wiring, battery adapted power components, and solar power components.

15 Claims, 6 Drawing Sheets

MAKE-UP MIRROR WITH AIRFLOW COMPONENT

CLAIM OF PRIORITY

This application claims priority to U.S. Provisional Application No. 61/100,183.

FIELD OF INVENTION

The present invention relates in general to the field of mirrors, and more specifically to a mirror having a fan component to direct airflow to a user's face.

BACKGROUND

Figure 1:
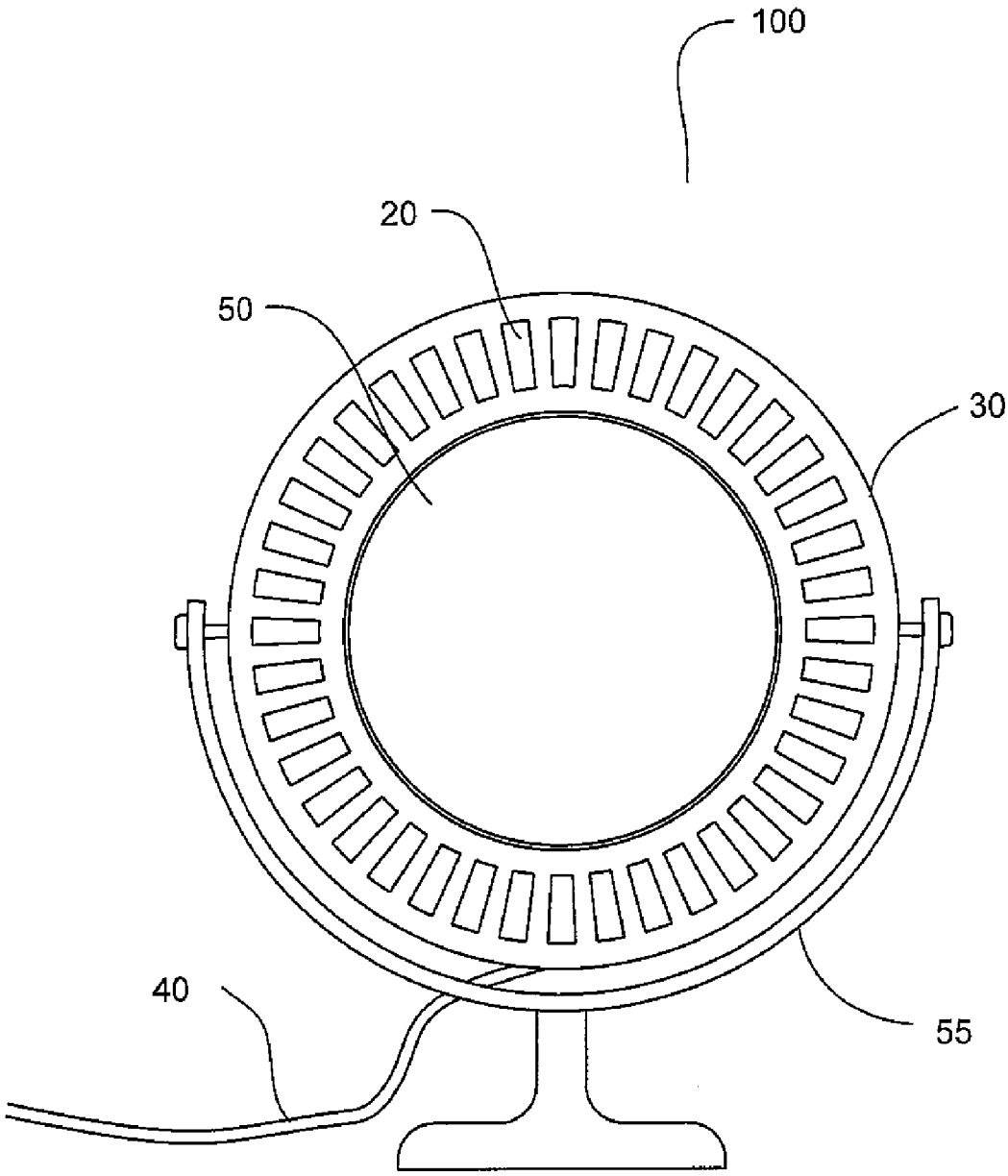
FIG. 1 Illustrates front view of one embodiment of a make-up mirror with an airflow component.

Make-up mirrors specifically adapted for use when applying make-up, styling hair, using cosmetic devices or performing other activities which require a view of the user's face are well known in the art. A swivel-type mirror is popular to allow users to move the mirror to provide the desirable reflection angle. Additionally, considerable competition exists for lighted make-up mirrors which allow users to see how make-up looks in various types of lighting (e.g., fluorescent and natural) and to illuminate the facial features to more easily apply make-up. Additionally, two-sided mirrors which have a magnifying mirror on one side are popular, as are a number of different stands, pedestals and mounting components.

Make-up mirrors are sold in large numbers of retails stores, and consumers have many choices in size, shape, style, base, materials, color and mounting options. There are numerous websites offering make-up mirrors in multiple styles and price points, such as the website www.makeupmirrors4you.com located at http://www.makeupmirrors4u.com/?gclid=CM-04Ou99ZUCFQOjFQodhSzohq. Competitors in the vast make-up mirror market include companies such as Vidal Sassoon, Homedics (See also; Swissco, Annick Goutal, Clinique, Nickel, Conair, Jerdon, Kimball & Young, Zadro Products, Bobbi Brown, Too Faced, BABOR, Sanrio). A typical retail store such as Target Corporation or Sears Holdings Corporation carries a number of make-up mirrors, and manufacturers compete for market share and shelf space among these major retailers. It is thus desirable to introduce a make-up mirror having enhanced functionality and capturing a greater market share.

One problem known in the application of make-up is that of perspiration and humidity making make-up more difficult to apply and causing it to smear or evaporate more quickly.

Another problem is the time involved in make-up application; it is necessary to allow liquid cosmetics such as foundation and eye-liner to dry after application, and for certain facial treatments and applications to dry prior to applying others.

In addition, make-up mirrors and mirrors in general tend to fog up in wet or steamy environments. Numerous attempts have been made to resolve this problem. Most attempts to defog mirrors involve heating the mirror in some form. Mirrors have been created which include a heat source around the perimeter of the mirror, either externally or electrically powered. When treated properly, mirrors can be defogged even in warm conditions.

It is desirable to have a make-up mirror that facilitates the application of make-up in hot and humid environments, and which facilitates proper application and drying of make-up.

GLOSSARY

As used herein, the term "mirror" means an object which a has specular reflection sufficient to form an image. A mirror may be curved, flat or have magnification or illumination capability.

As used herein, the term "flush mount" means mounted flush or with minimal protrusion from the surface of a wall.

As used herein the term "hard-wired" means connected to the electrical system of a building or structure.

As used herein the term "wall mounting component" or "arm" means any structural component adapted to attach a make-up mirror with airflow to a wall without interrupting the venting or airflow functionality, including but not limited to brackets.

As used herein, "stand" means any structure adapted to support a make-up mirror with airflow on a planar surface (e.g., table or countertop), and may include pivotal or lighted components or elements of a housing.

As used herein, a "housing" means any structure adapted to support and encase one or more elements including a fan power source, a fan rotor, and vents and/or mirror with airflow, and which may include optional elements such as lighting, tinted lighted, ornamental design components and audio or visual components.

As used herein, a "fan" or "airflow" component is a device which creates airflow by using a power source to turn a rotor, fan blades, fin or other structural element which may be adapted to create airflow.

As used herein, a "light" or "lighting component" means any component for illumination or visual effect, and may include variable or selective lighting to emulate fluorescent, natural lighting, stage lighting, pixilated lighting or any other type of lighting known in the art.

As used herein the term "power source" means an electrical power source, battery power, solar power or any other power which may be used to power the motion of a fan rotor and/or other component.

SUMMARY OF THE INVENTION

The invention disclosed herein is a make-mirror designed to direct airflow to the face, by embedding a mirror a housing that encases a fan, and is vented to direct airflow to a user's face. Various embodiments may include lighting, bases, stands, extension arms, components for flush mounting the invention to a wall, electrical wiring, battery adapted power components, and solar power components.

DETAILED DESCRIPTION OF DRAWINGS OF THE INVENTION

For the purpose of promoting an understanding of the present invention, references are made in the text hereof to embodiments of a make-up mirror with integrated air-blowing component, only some of which are depicted in the figures. It should nevertheless be understood that no limitations on the scope of the invention are thereby intended. One of ordinary skill in the art will readily appreciate that modifications such as the dimensions, size, and shape of the components, alternate but functionally similar materials from which a make-up mirror and air-blowing component is made, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related.

For the purposes of promoting an understanding of the principles of the invention reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

FIG. 1 illustrates a front view of make-up mirror with airflow component 100. In the embodiment shown, pivotal stand 55 supports mirror 50 and is fastened to housing 30 of mirror 50. Fasteners attach housing 30 to pivotal stand 55 so that mirror 50 can pivot on its horizontal axis. Pivotal stand may also independently pivot on its vertical axis. Fan housing 30 extends and encases the front outer edge of mirror 50. Housing 30 can be tinted or clear, plastic, brass, metal, precious metal, ceramic, wood, or composites (such as paper machet). In the embodiment shown, fan housing 30 contains a plurality of vents 20 on the front, mirror side of the apparatus, which allow fan-generated air to be blown on a user's face. In the embodiment shown, power cord 40 connects to a power source (which is not visible in drawing) encased within housing 30 which drives fan 45 (not visible in drawing) through a motor in the bottom of the housing 30. In the embodiment shown, power cord 40 is attached to the bottom of housing, but other embodiments may use alternative sources of power to drive fan 45 such as battery or solar power.

Figure 2:
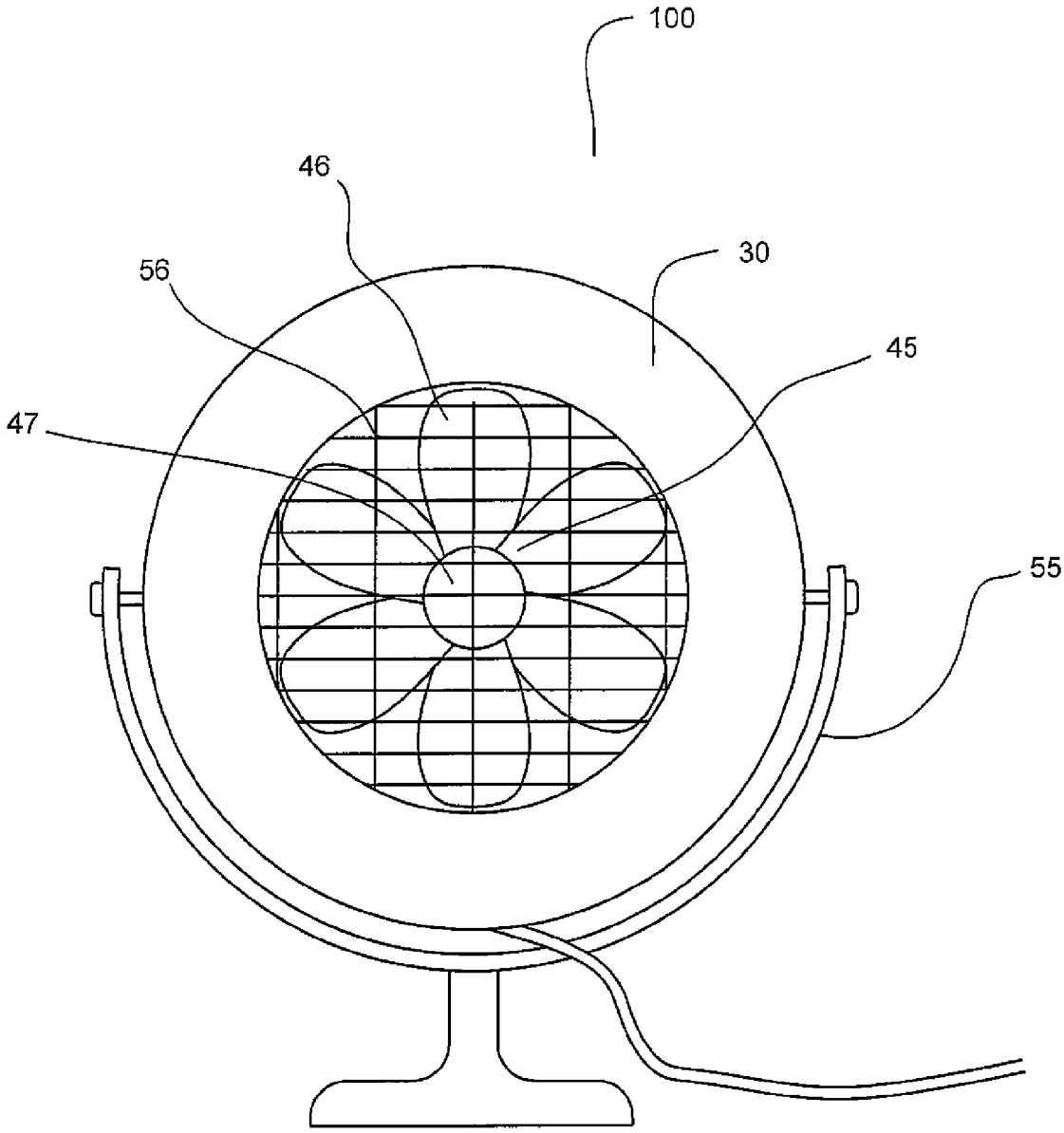
FIG. 2 Illustrates back view of one embodiment of a make-up mirror with an airflow component.

Referring to FIG. 2, the rear view of an additional exemplary embodiment of make-up mirror 100 in which fan 45 is visible. In the embodiment shown, housing 30 is mounted pivotally or rotationally on stand 55. Fan 45 includes a plurality of blades 46 with are attached to rotor 47 fastened driven by power source 60. Blades 46 are encased in housing 30 but do not touch any wall of housing. Vent 56 is shown behind fan 45 to dissipate heat generated by the motor running the fan.

Figure 3:
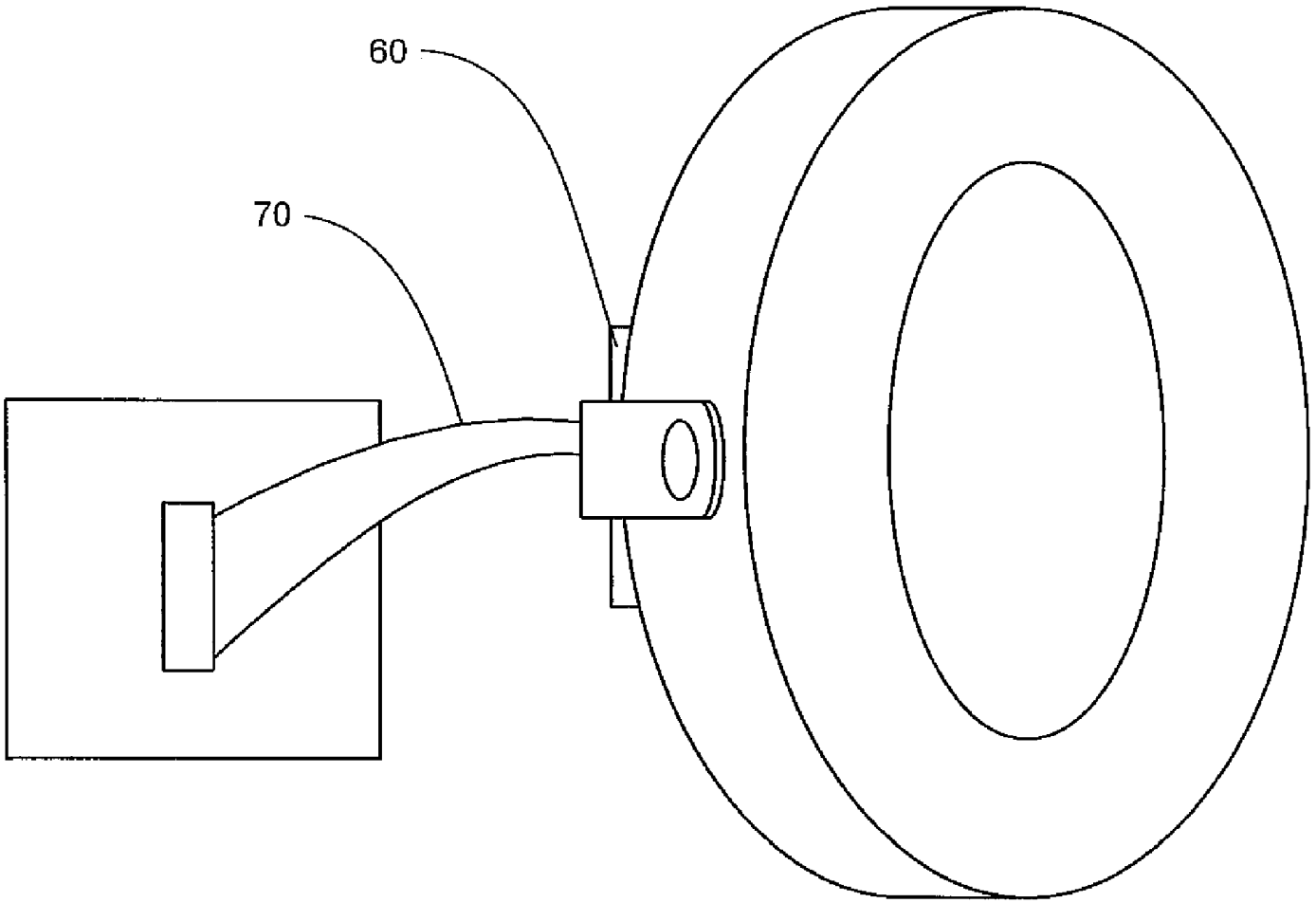
FIG. 3 Illustrates an alternate embodiment of a make-up mirror with an airflow component having an arm.

FIG. 3 illustrates an exemplary embodiment of make-up mirror with airflow component 100. In this embodiment, mirror contains arm 70, which can be fastened to most vertical structures. In various embodiments, arm 70 contains a fastening mechanism, such as screws, nails, hooks or glue. In this embodiment, power source 60 is attached through housing 30 (e.g. a power cord), but in other embodiments power source 60 may be encased within housing 30 to power fan 45. Power source 60 may be any which generates power to run fan 45, such as battery power or solar power.

Figure 4:
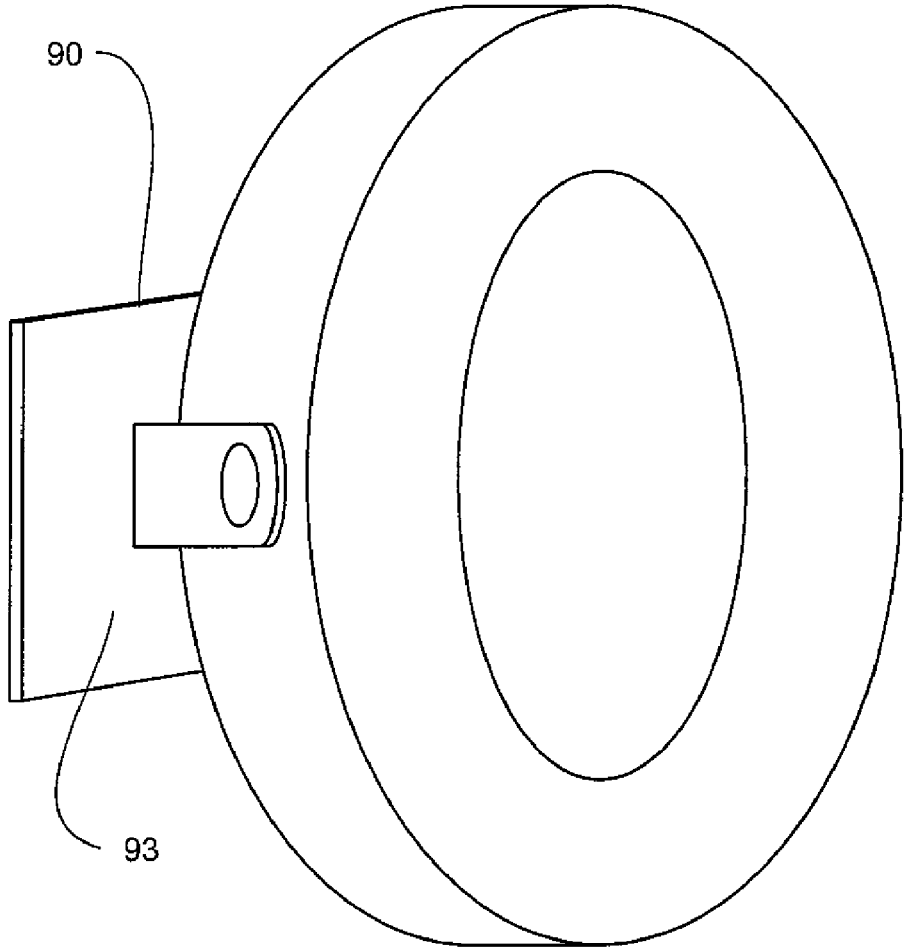
FIG. 4 Illustrates an alternate embodiment of a make-up mirror with an airflow component having a wall mount component, which may optionally be hardwired and flush-mounted to a wall.

FIG. 4 illustrates an alternate embodiment of make-up mirror with airflow component 100 which includes wall mounting bracket 90 which attaches to housing 30 to support and attach make-up mirror with airflow component 100 to a wall. In various embodiments mounting bracket 90 may further include a fastening mechanism, such as screws, nails, hooks, glue or electrical socket, which attaches the mount to a vertical structure. Other embodiments of make-up mirror with airflow component 100 may be me constructed from multiple components, may slide, be pivotable or be adjustable for height or angle.

Figure 5A:
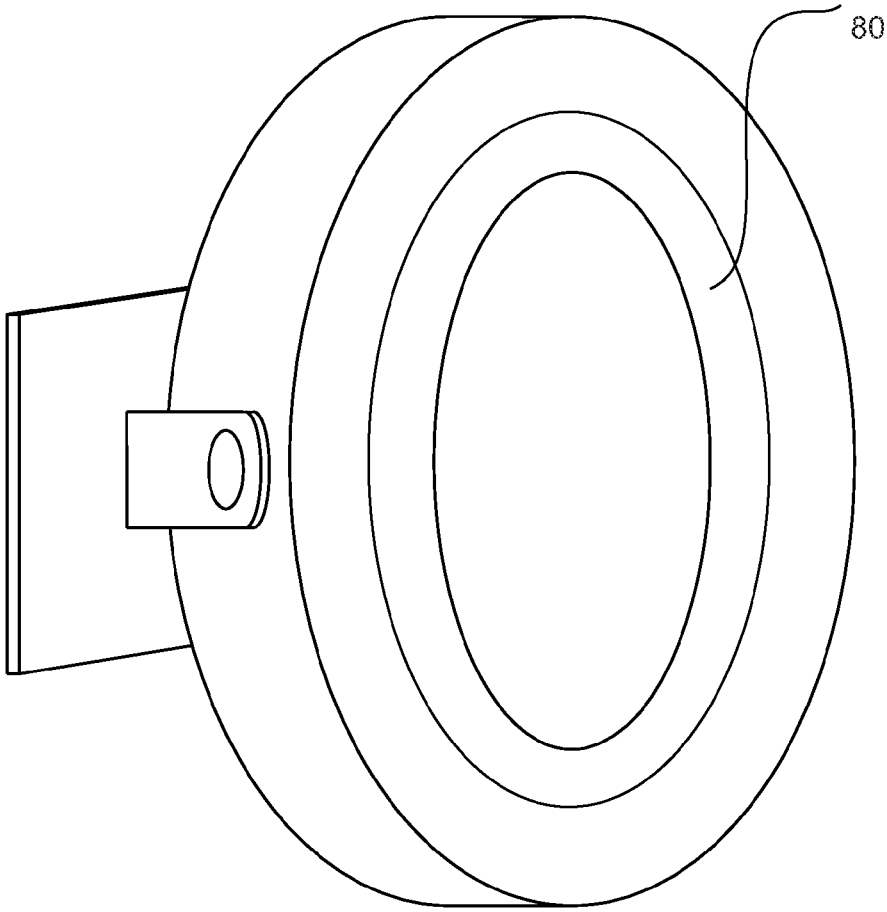
FIGS. 5*a* and 5*b* Illustrate alternate embodiments of a make-up mirror with an airflow component having optional lighting components.
Figure 5B:
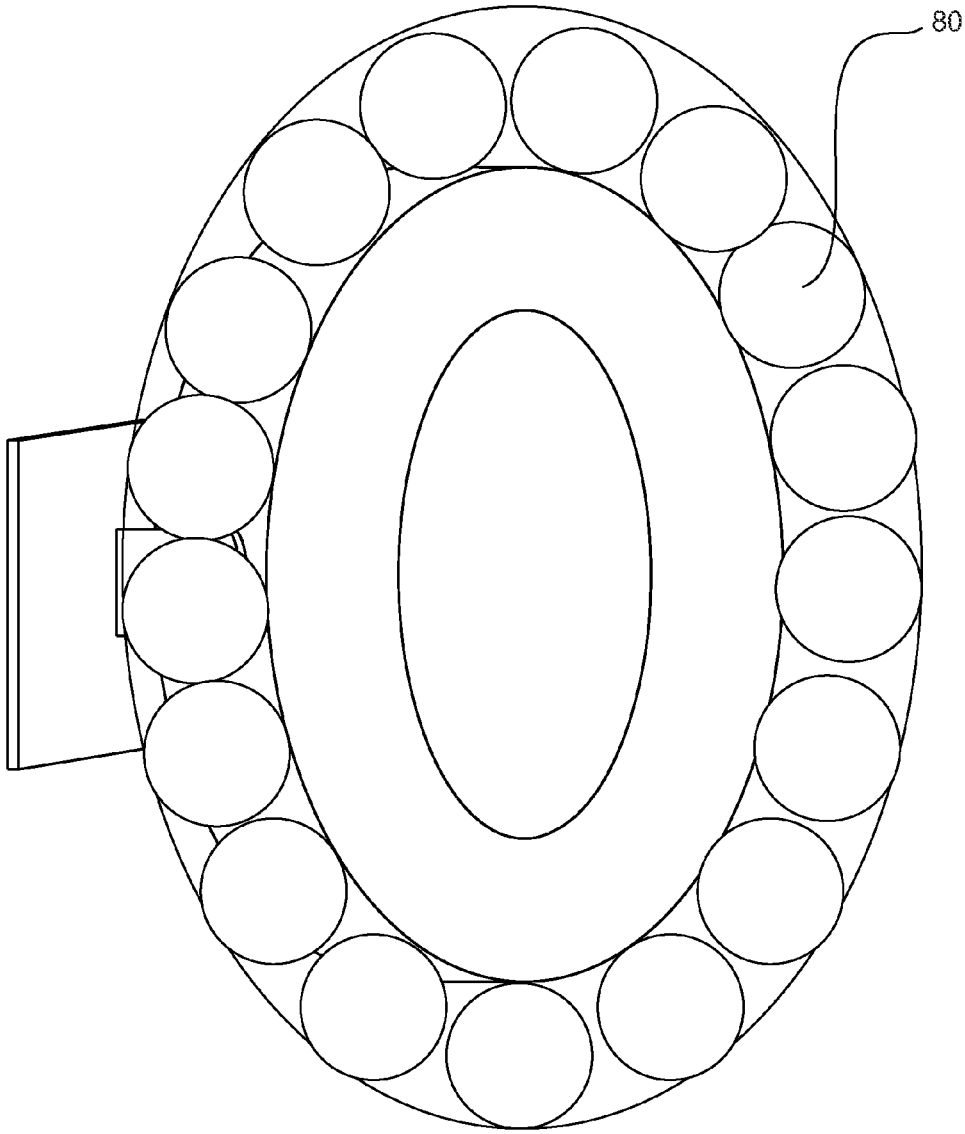

FIGS. 5 and 5*b* illustrates alternate embodiments of make-up mirror with airflow component 100 which include optional lighting component 80 to illuminate the face or create a particular aesthetic lighting effect. In the embodiment shown, optional lighting components 80 are shown fastened to housing 30 and are powered by a inner battery-powered motor. Alternatively, optional lighting component 80 can be integrated into housing 30, fastened in front of mirror, or added to the outside of housing 30. Like fan 45, lights 80 can be powered electrically or by battery or solar power via any power source adapted to power fan 45.

What is claimed is:

1. A make-up-mirror housing comprising:

an airflow component;

a base component having a first diameter with a central cavity adapted to enclose said airflow component and a concavely shaped front surface forming a central mirror-securing recess, said concavely shaped front surface with a plurality of radial apertures operable to redirect the flow of air;

at least one mirror having a second diameter fixably attached within said mirror-securing recess and operable to be used by a person;

wherein said first diameter is larger than said second diameter, and said base component and said mirror are concentric with collinear axes;

a mirror-securing rim extending from the circumference of said mirror-securing recess and encasing the outer front edge of said mirror;

at least two pivot apertures adapted to receive pivoting fasteners;

at least one ventilation aperture located on the back surface of said base component;

a motor compartment; and a power source aperture.

2. The make-up-mirror housing of claim 1 which further includes a pivotal stand, wherein said pivotal stand includes at least two pivoting fasteners for pivoting along a horizontal axis and a pivotable anchoring component for independently pivoting said housing along a vertical axis.

3. The make-up mirror housing of claim 1 which further includes at least one wall mount component.

4. The make-up mirror of claim 1 which further includes a plurality of mirrors, wherein at least one of said plurality of mirrors is capable of magnifying an image.

5. The makeup mirror of claim 1 which further includes at least one lighting component.

6. The makeup mirror of claim 1 wherein at least one lighting component is capable of producing multiple lighting effects selected from a group consisting of fluorescent lighting, natural lighting, stage lighting, tinted lighting and pixilated effect lighting.

7. The makeup mirror housing of claim 1 further adapted to be flush mounted in a wall and powered electrically.

8. The makeup mirror housing of claim 1 wherein said airflow component is powered by a power source selected from a group consisting of battery power, electrical power, solar power, the electrical system of a building, a solar power system of a building and a hydro-electric power system of a building.

9. A make-up mirror housing comprising:

an airflow component;

a base component with a first diameter and a central cavity adapted to enclose said airflow component and a concavely shaped front surface forming a central mirror-securing recess, said concavely shaped front surface containing a plurality of radial apertures operable to redirect the flow of air;

at least one mirror having a second diameter fixably attached within said mirror-securing recess and operable to be used by a person;

wherein said first diameter is larger than said second diameter, and said base component and said mirror are concentric with collinear axes;

a mirror-securing rim extending from the edge of said mirror-securing recess and encasing the outer front edge of said mirror;

at least two pivot apertures adapted to receive pivoting fasteners;

at least one ventilation aperture located on the back surface of said base component;

a motor compartment containing a motor;

a power source aperture opening to said motor compartment;

a power source which powers said airflow component; and a pivotal stand with an independently rotatable anchoring component, wherein said pivotal stand includes at least two pivoting fasteners pivotally attaching said base component to aid pivotal stand.

10. The make-up-mirror housing of claim 9 which further includes at least one wall mount component.

11. The make-up mirror of claim 9 which includes a plurality of mirrors, wherein at least one of said plurality of mirrors is capable of magnifying an image.

12. The make-up mirror of claim 9 which further includes at least one lighting component.

13. The makeup mirror of claim 9 wherein said at least one lighting component is capable of producing multiple lighting effects selected from a group consisting of fluorescent lighting, natural lighting, stage lighting, tinted lighting and pixilated effect lighting.

14. The makeup-mirror housing of claim 9 further adapted to be flush mounted in a wall and powered electrically.

15. A make-up mirror housing comprising:

a plurality of blades fixably attached to a rotor;

a base component with a first diameter and having a central cavity adapted to enclose said plurality of blades fixably attached to a rotor and a concavely shaped front surface forming a central mirror-securing recess, wherein said concavely shaped front surface contains a plurality of radial apertures around said central mirror-securing recess and operable to redirect the flow of air;

at least one mirror with a second diameter fixably attached with said mirror-securing recess and operable to be used by a person;

wherein said first diameter is larger than said second diameter, and said base component and said mirror are concentric and have collinear axes;

a mirror-securing rim extending from the edge of said mirror-securing recess and encasing the outer front edge of said mirror;

at least two pivot apertures adapted to receive pivoting fasteners;

at least one ventilation aperture located on the back surface of said base component;

a motor compartment containing a motor;

a power source aperture opening to said motor compartment;

a power source which causes said rotor to turn;

a pivotal stand with an independently rotatable anchoring component, wherein said pivotal stand includes at least two pivoting fasteners pivotally attaching said base component to said pivotal stand; and at least one lighting component mounted on the perimeter of said front surface of said base component and powered by said power source.

* * * * *